US006862888B2

(12) United States Patent
Akagi et al.

(10) Patent No.: US 6,862,888 B2
(45) Date of Patent: Mar. 8, 2005

(54) PILOT NOZZLE FOR A GAS TURBINE COMBUSTOR AND SUPPLY PATH CONVERTER

(75) Inventors: Kouichi Akagi, Hyogo (JP); Taku Ichiryu, Hyogo (JP); Kazuhiro Matsui, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 60 days.

(21) Appl. No.: 10/076,643

(22) Filed: Feb. 19, 2002

(65) Prior Publication Data

US 2003/0024249 A1 Feb. 6, 2003

(30) Foreign Application Priority Data

May 30, 2001 (JP) ..... 2001-163489

(51) Int. Cl.[7] ..... F02C 1/00; F02G 3/00

(52) U.S. Cl. ..... 60/740; 60/746; 60/39.463; 60/747

(58) Field of Search ..... 60/740, 746, 747, 60/39.463

(56) References Cited

U.S. PATENT DOCUMENTS 5,359,847 A * 11/1994 Pillsbury et al. ..... 60/39.463
5,408,825 A * 4/1995 Foss et al. ..... 60/39.463
5,647,215 A * 7/1997 Sharifi et al. ..... 60/737
5,657,632 A * 8/1997 Foss ..... 60/742
5,784,875 A * 7/1998 Statler ..... 60/775
6,122,916 A * 9/2000 Amos et al. ..... 60/747
6,282,904 B1 * 9/2001 Kraft et al. ..... 60/739
2003/0051478 A1 * 3/2003 Matsuyama et al. ..... 60/725

* cited by examiner

*Primary Examiner*—Cheryl J. Tyler
*Assistant Examiner*—William H. Rodriguez
(74) *Attorney, Agent, or Firm*—Oblon, Spivak, McClelland, Maier & Neustadt, P.C.

(57) ABSTRACT

This pilot nozzle has a fuel oil supply pipe disposed at the center of a heat-shielding air layer that is provided along an axial core, and a plurality of atomized-fluid supply paths are disposed in the circumferential direction of a cylinder unit that surrounds the outside of the heat-shielding air layer. The atomized-fluid supply paths and the fuel gas supply paths are disposed alternately and uniformly. Based on this structure, it is possible to take a large thickness for the heat-shielding air layer to a maximum extent in a radial direction. Therefore, it is possible to protect the fuel oil supply pipe disposed at the center, from high temperature at the outside of the pilot nozzle.

6 Claims, 12 Drawing Sheets

D-D

PILOT NOZZLE FOR A GAS TURBINE COMBUSTOR AND SUPPLY PATH CONVERTER

FIELD OF THE INVENTION

The present invention relates to a pilot nozzle and a supply path converter that have an internal structure provided with a measure against heat conduction from external high-temperature air.

BACKGROUND OF THE INVENTION

FIG. 11 is a construction diagram showing a pilot nozzle of a conventional gas turbine combustor. A combustor in a gas turbine is a portion that mixes fuel with high-temperature compressed air from a compressor, to combust the fuel. This combustor has a main nozzle (not shown) for carrying out main combustion, and a pilot nozzle 30 for maintaining a flame that becomes a pilot near the main nozzle, disposed inside its internal cylinder.

The pilot nozzle 30 is supplied with a pilot fuel like fuel oil or fuel gas from a rear end portion 31. Among the pilot fuels supplied, the fuel oil passes through a fuel oil supply pipe 33 that is disposed to pierce through the center of a heat-shielding air layer 32 in its axial direction that is provided along the axial core portion, and the fuel is jetted from a front end nozzle 34. Further, the inside of the pilot nozzle also has a structure for supplying an atomized fluid to diffuse the jetting of the fuel, and jetting the fluid from the front end.

FIG. 12 is a cross-sectional view showing the front end portion of the nozzle shown in FIG. 11. The pilot nozzle 30 has a concentric circular multi-layer structure. In other words, the fuel oil supply pipe 33, heat-shielding air layer 32, internal cylinder 35, atomized-fluid supply path 36, and the external cylinder 37 are concentrically combined together from the inside. Further, a pilot nozzle of what is called a duel-fuel system that uses fuel oil and fuel gas by switching between them or uses both as pilot fuel, has had a three-layer structure. Namely, a gas supply pipe 38 is concentrically combined with the fuel oil supply pipe 33 at the further outer side of the external cylinder 37, and this supply pipe 38 is sealed with an exterior cylinder 39.

As explained above, the pilot nozzle 30 is exposed to the high-temperature compressed air, and receives thermal conduction from the external surface. On the other hand, the fuel oil that flows through the inside of the fuel oil supply pipe at the pilot nozzle axial core portion has a lower temperature than the temperature of this air. Therefore, there arises a difference between the thermal expansion of the external cylinder of the pilot nozzle and the thermal expansion of the fuel oil supply pipe in proportion to this temperature difference. Consequently, there has been a problem that when this difference in the thermal expansion is large, a position of the jet nozzle at the front end changes, and this gives bad influence to a state of the diffusion of the jetted fuel.

Further, when the fuel gas is not used, the thermal conduction from the high-temperature compressed air at the outside of the pilot nozzle gives particularly large influence to the fuel oil at the axial core portion. This brings about a caulking phenomenon due to the rise in temperature. As a result, there has been a problem that a smooth supply of the fuel oil is interrupted, and in the worst case, it is not possible to use the fuel oil.

SUMMARY OF THE INVENTION

It is an object of this invention to provide a pilot nozzle for a gas turbine combustor for improving the heat-shielding effect of the pilot nozzle. Further, it is another object of the invention to provide a pilot nozzle for a gas turbine combustor capable of preventing bad influence of thermal expansion, and a supply path converter that is used for this pilot nozzle.

The pilot nozzle for a gas turbine combustor according to one aspect of this invention comprises a fuel oil supply pipe passed through a cylinder unit provided in an axial direction of the pilot nozzle, a heat-shielding air layer formed between the fuel oil supply pipe and the cylinder unit, and a plurality of atomized-fluid supply paths provided in a circumferential direction of the cylinder unit.

According to the above aspect, a plurality of atomized-fluid supply paths are provided in a circumferential direction of the cylinder unit, thereby to structure a pilot nozzle of what is called a single-fuel system. Based on this structure, it is possible to allow a larger thickness for a heat-shielding air layer in the radial direction, as compared with a structure of securing a flow path by concentrically superimposing cylinders in multi-layers. As a result, it is possible to suppress a rise in temperature of the fuel oil due to the high-temperature air at the outside of the pilot nozzle.

The pilot nozzle for a gas turbine combustor according to another aspect of this invention comprises a fuel oil supply pipe passed through a cylinder unit provided in an axial direction of the pilot nozzle, a heat-shielding air layer formed between the fuel oil supply pipe and the cylinder unit, and a plurality of atomized-fluid supply paths and fuel gas supply paths provided in a circumferential direction of the cylinder unit.

According to the above aspect, a plurality of atomized-fluid supply paths and fuel gas supply paths are provided in a circumferential direction of the cylinder unit. With this arrangement, a pilot nozzle of what is called a duel-fuel system that uses fuel oil and fuel gas by switching between them or uses both as pilot fuel, is structured. In this case, it is also possible to allow a larger thickness for a heat-shielding air layer in the radial direction, as compared with a structure of securing a flow path by concentrically superimposing cylinders in multi-layers. As a result, it is possible to reduce a rise in temperature of the fuel oil due to the high-temperature air at the outside of the pilot nozzle. The fuel gas supply path may be provided at an external edge of the cylinder.

The supply path converter according to still another aspect of this invention is a cylindrical structure disposed inside the cylindrical space and having a hollow inside the structure, has a hole A provided at a center portion of the end surface at one end, and has a hole B communicated to the inside of the cylindrical structure and a flow path C communicated to the outside of the cylindrical structure, formed respectively at the outside of the end surface in a radial direction of the hole A. The fuel oil supply pipe having substantially the same diameter as the hole A is passed through the hole A, and the hole B and the flow path C are connected with supply paths disposed in a circumferential direction of the same end surface respectively.

As a pipe having substantially the same diameter is passed through the hole A, a ring-shaped space is formed inside the cylindrical structure and outside the pipe. When a fluid that flows through a supply path (for example, an atomized-fluid supply path) disposed in the circumferential direction enters the hole B, this fluid flows inside the cylindrical structure, and flows through the ring-shaped space.

Further, when a fluid supplied from a separate supply path (for example, a fuel gas supply path) enters the flow path C, this fluid flows to the outside of the cylindrical structure. As the cylindrical structure is disposed at the inside of the cylindrical space, the fluid flows circularly in the outside of the side portion of the cylindrical structure and the inside of the cylindrical space. The flow path C may be a hole, or a groove formed inward from the external edge portion.

As explained above, the supply path converter according to above aspect distributes a plurality of supply paths disposed in a circumferential direction, to the inside and the outside of the converter. From the viewpoint of designing, it is preferable to set the external size of the end surface in which the hole A is perforated larger than the external size of the other end, thereby smoothly changing the external size between these portions. This makes it possible to smoothly distribute the fluid that enters from the supply paths.

Other objects and features of this invention will become apparent from the following description with reference to the accompanying drawings.

BRIEF DESCRIPTION OF THE DRAWINGS

FIGS. 2A and 2B are external construction diagrams showing examples of the structure that absorbs thermal expansion of the fuel oil supply pipe, in which FIG. 2A shows the structure having flexibility and FIG. 2B shows the structure having a bending while having flexibility, FIGS. 3A and 3B are external construction diagrams showing examples of the structure that absorbs thermal expansion based on a shape of the fuel oil supply pipe, in which FIG. 3A shows the structure that partially utilizes a circular arc shape and FIG. 3B shows the structure that utilizes a U-shape, FIGS. 4A, 4B, and FIG. 4C are external construction diagrams showing examples of the structure that absorbs thermal expansion, in which FIG. 4A shows the structure using a sealing member, FIG. 4B is the structure for feeding cooling fluid to/from the whole surrounding of the pipe, and FIG. 4C is the structure having a fine pipe, through which a cooling fluid passes, wound around the pipe.

DETAILED DESCRIPTIONS

This invention will be explained in detail below with reference to the drawings. This invention is not limited to an embodiment explained below.

Figure 1:
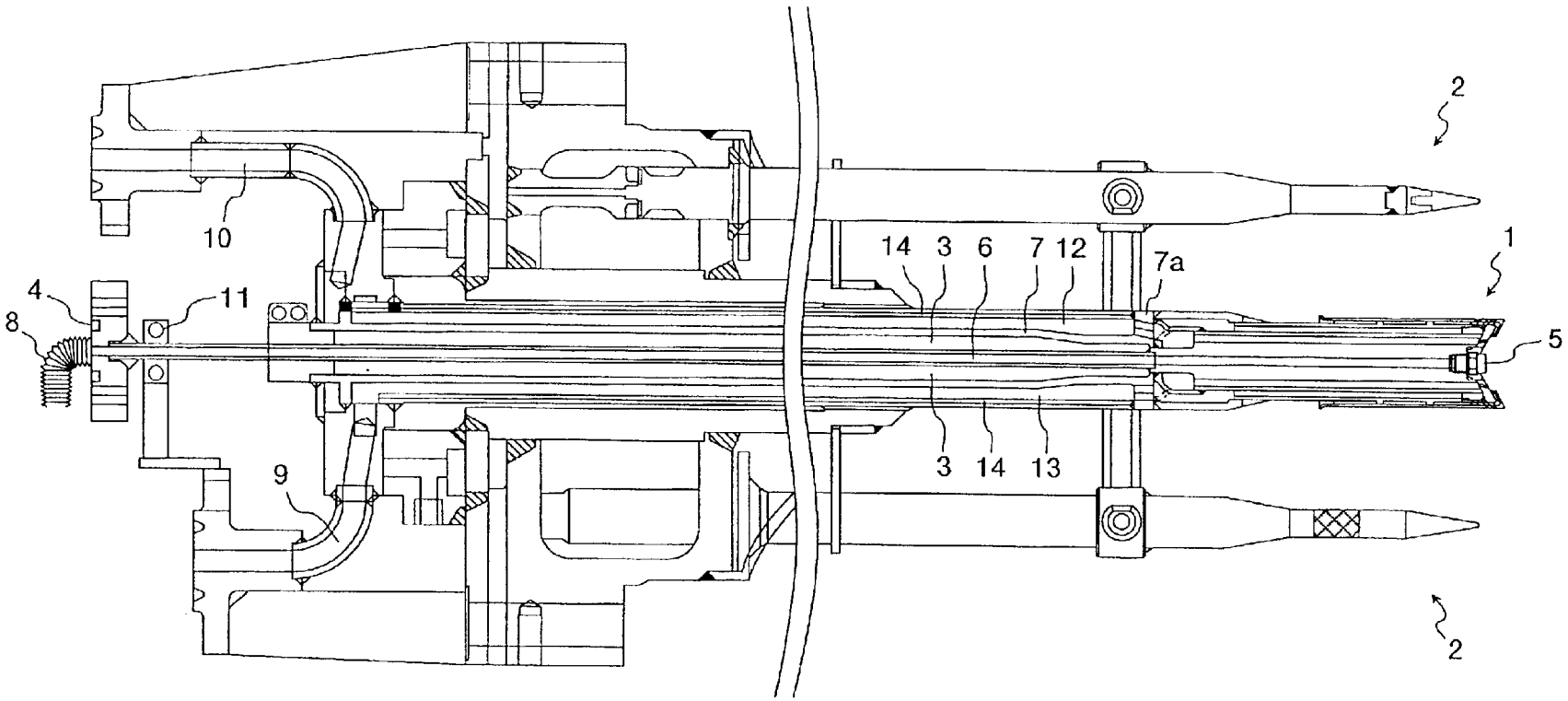
FIG. 1 is a construction diagram showing the pilot nozzle for a gas turbine combustor according to an embodiment of this invention.

FIG. 1 is a construction diagram showing a pilot nozzle for a gas turbine combustor relating to the embodiment. The pilot nozzle 1 is disposed within an internal cylinder of the combustor. In general, a plurality of main nozzles 2 are disposed near the pilot nozzle 1 to surround this pilot nozzle 1. For the sake of convenience in explanation, it is assumed that the pilot nozzle is separated into a front end and a rear end (a fuel inlet side), at an end portion 7*a* of a cylinder unit 7 as a boundary. The rear end is disposed with a fuel oil supply pipe 6 along the center of the axis. A heat-shielding air layer 3 is formed with a cylinder unit 7 around the fuel oil supply pipe via spacers (not shown).

A plurality of independent grooves 12 or 13 are formed inward from one external edge respectively in parallel with the axial center, on the surface of the external periphery of the casing 7. The grooves are covered with external plates 14 from the outside, thereby to form flow paths. The flow paths are used as atomized-fluid supply paths 12 at one side and as fuel gas supply paths 13 at the other side. The atomized-fluid supply paths 12 and the fuel gas supply paths 13 are provided on the same surrounding in such a manner. The rear end portion of the pilot nozzle 1 is connected with a fuel oil supply source, and an atomized fluid supply source. In the case of a duel-fuel system, the rear end portion of the pilot nozzle 1 is further connected with pipes 8, 9, and 10 for supplying a fluid respectively from a gas supply source.

A rearmost end portion 4 of the fuel oil supply pipe 6 is held with a plummer block 11, and is not restricted to an axial direction. In this case, the side face of the fuel oil supply pipe 6 may have slide grooves formed in an axial direction, or may be in the form of a cylinder as it is, without forming the grooves. With this arrangement, the rearmost end portion of the fuel oil supply pipe 6 has a degree of freedom in the axial direction, and becomes slidable. Accordingly, even when the fuel oil supply pipe 6 is displaced in the axial direction due to its thermal expansion (or compression), it is possible to avoid damaging a pipe welded portion or giving influence to a position of a jet nozzle 5.

Figure 2A:
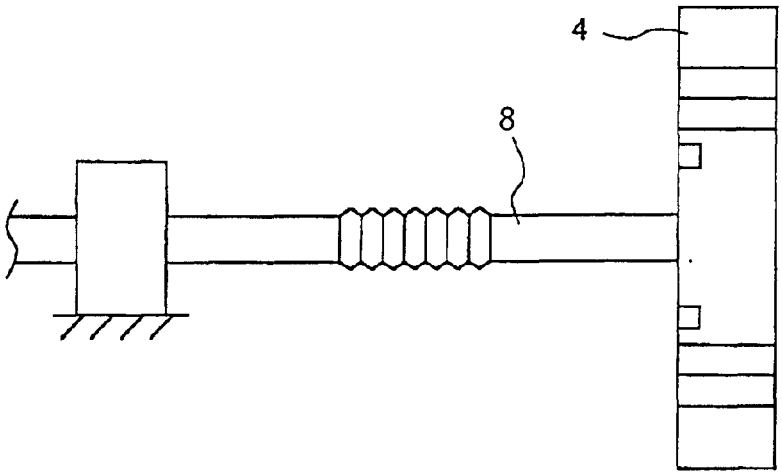
Figure 2B:
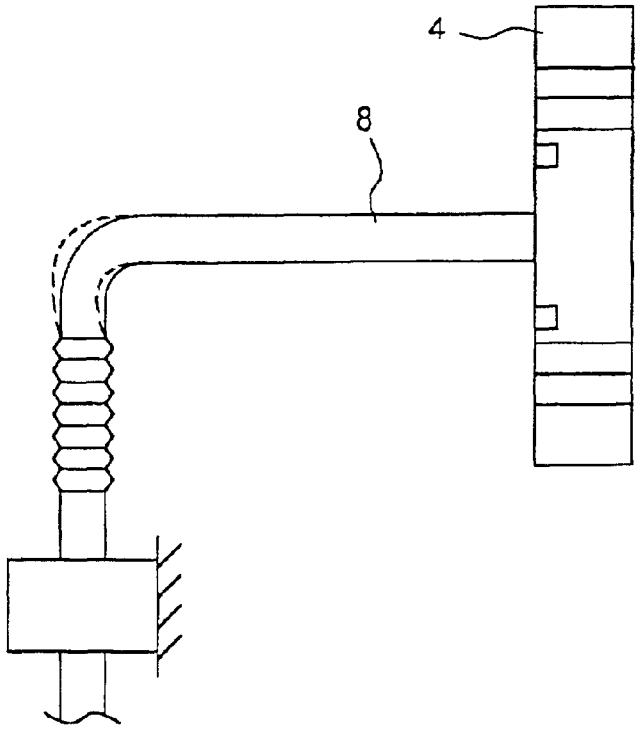

FIG. 2A and FIG. 2B are external construction diagrams showing examples of a structure that absorbs thermal expansion of the fuel oil supply pipe. FIG. 2A shows a structure having flexibility in a backward extended portion of the fuel oil supply pipe 6, and FIG. 2B shows a structure having a bending of the pipe while having flexibility in the same manner as that of FIG. 2A. By forming the rearmost end portion of the fuel oil supply pipe 6 as shown in FIG. 2A or FIG. 2B, even if the fuel oil supply pipe 6 expands backward due to thermal expansion, the flexible portion absorbs the thermal expansion. Thus, it becomes possible to arrange the piping without damaging the fuel supply function of the pipe. With this arrangement, it is possible to avoid exerting an influence on a position of the jet nozzle 5 due to the thermal expansion of the fuel oil supply pipe 6 by itself or due to a difference in the thermal expansion between the cylinder unit 7 or the external plates 14 and the fuel oil supply pipe 6.

Figure 3A:
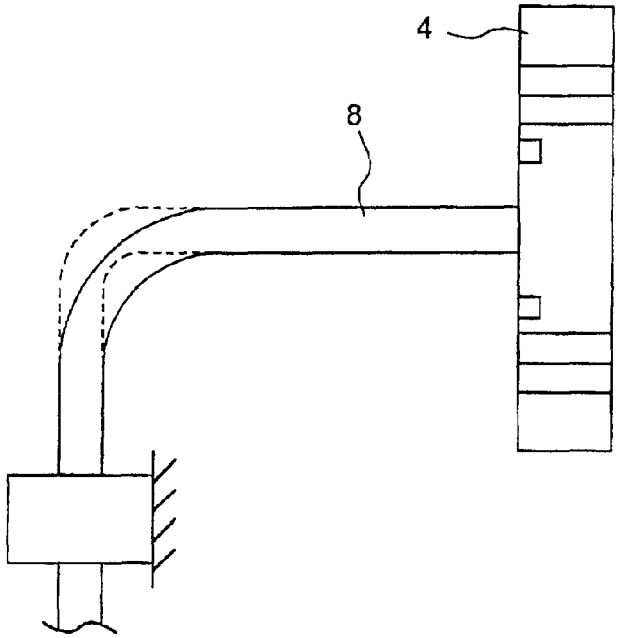
Figure 3B:
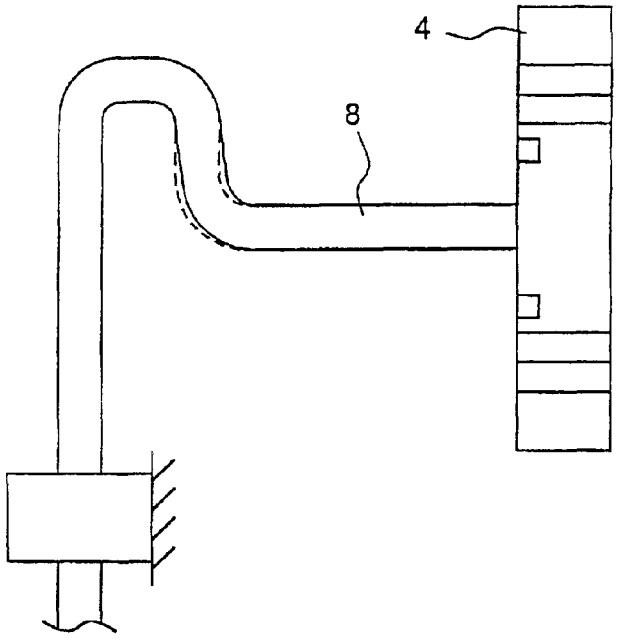

FIG. 3A and FIG. 3B are external construction diagrams showing examples of a structure that absorbs thermal expansion based on a shape of the fuel oil supply pipe. FIG. 3A shows a structure that partially utilizes a circular arc shape, and FIG. 3B shows a structure that utilizes a U-shape. It is also possible to absorb thermal expansion of the fuel oil supply pipe 6 by using a curved shape and an elastic deformation as shown in these drawings.

Figure 4A:
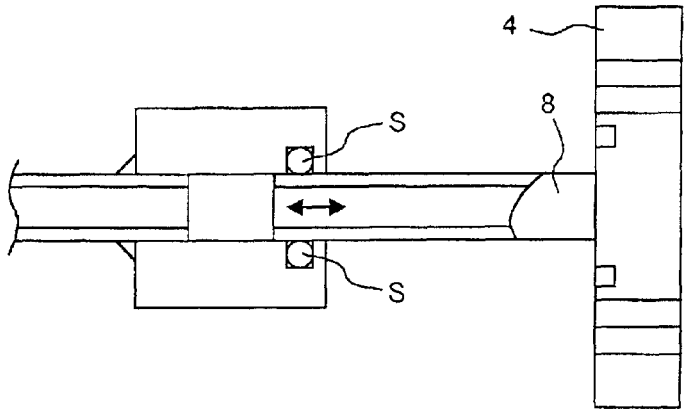
Figure 4B:
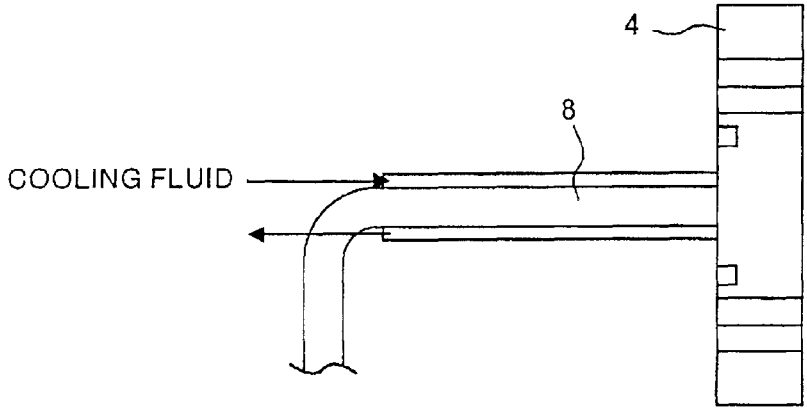
Figure 4C:
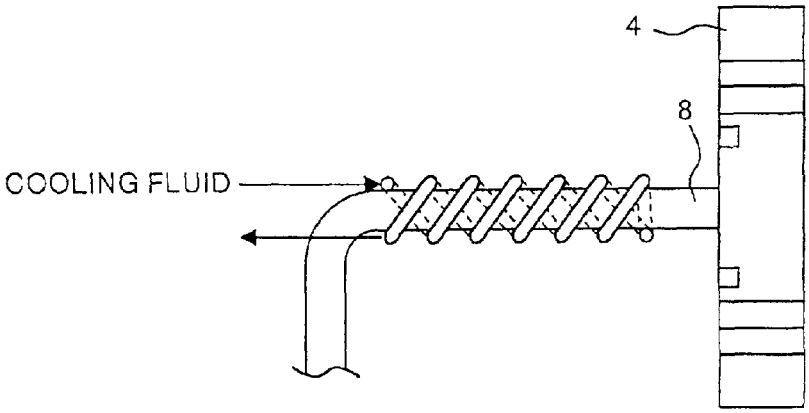

FIGS. 4A, 4B, and FIG. 4C are external construction diagrams showing examples of a structure that absorbs thermal expansion. FIG. 4A shows a structure capable of moving one of divided fuel oil supply pipes while being sealed with a sealing material S. FIG. 4B is a structure for feeding cooling water or cooling air into/from the whole surrounding of the pipe. FIG. 4C is a structure having a fine pipe, through which cooling water or cooling air passes, wound around the fuel oil supply pipe. According to FIG. 4A, it is possible to secure an escape of thermal expansion of the fuel oil supply pipe 6 when it expands in the axial direction, by using the space provided between the divided pipes, and to prevent leakage of the fuel oil by a sealing member.

Further, FIGS. 4B and 4C show structures for reducing the expansion, by positively cooling the pipe with cooling water or cooling air or other cooling fluid. With this arrangement, it is also possible to avoid exerting an influence on a position of the jet nozzle 5 due to the thermal expansion of the fuel oil supply pipe 6 by itself or due to a difference in the thermal expansion between the cylinder unit 7 or the external plates 14 and the fuel oil supply pipe 6.

Referring back to FIG. 1, the outside of the pilot nozzle 1 is exposed to the high-temperature compressed air. As the temperature of the fuel oil that flows through the fuel oil supply pipe 6 is lower than that of the external air, the fuel oil supply pipe 6 is compressed relative to the cylinder unit 7. This relative compression is proportional to the area of thermal conduction. Therefore, when the cylinder unit end portion 7*a* is disposed at a position of the pilot nozzle 1 as forward as possible, most of the compression appears at the rear portion from the cylinder unit end portion 7*a*. Accordingly, by releasing this compression based on the above structures of absorbing thermal expansion (compression), it becomes possible to eliminate any influence to the position of the jet nozzle at the front end of the pilot nozzle 1.

Figure 5:
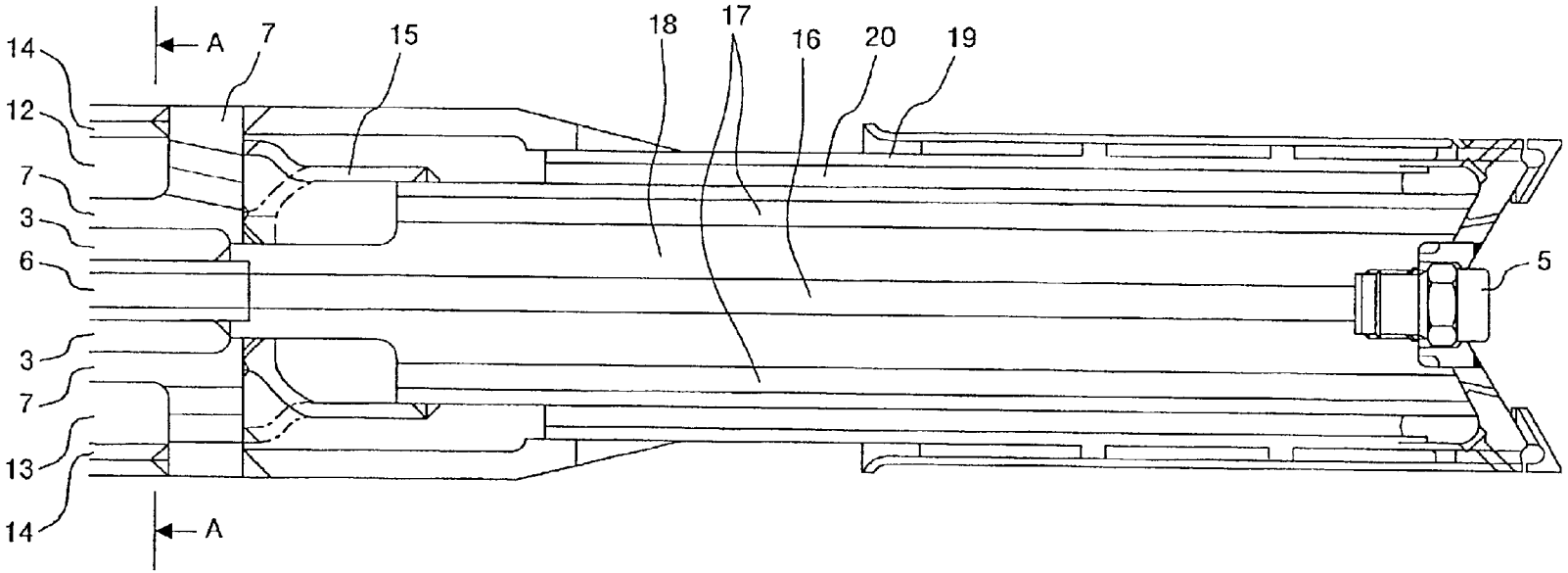
FIG. 5 is an enlarged cross-sectional view of the front end portion of the pilot nozzle shown in FIG. 1.

FIG. 5 is an enlarged cross-sectional view of the front end portion of the pilot nozzle shown in FIG. 1. This figure shows a cross section of the pilot nozzle cut along an L-shaped surface bent at a right angle with respect to the axial core. As described above, the rear end portion of the cylinder unit 7 is structured by sequentially disposing the heat-shielding air layer 3, cylinder unit 7, atomized-fluid supply paths 12 or fuel gas supply paths 13, and the external plates 14, in this order toward the outside in a radial direction, around the fuel oil supply pipe 6.

The front end of the pilot nozzle has a trunk cylinder unit 18 provided with a fuel supply path 16 at the center. A ring-shaped inter-cylinder flow path 17 is disposed inside the cylinder unit, and an atomized fluid is flown through this flow path. An external cylinder unit 19 is fitted to the surrounding of the trunk cylinder unit. Fuel gas is flown through a ring-shaped inter-cylinder flow path 20 as a space of this interval. The front end and the rear end of the pilot nozzle are connected together by a supply path converter 15, thereby to supply the fluid smoothly from the rear end to the front end.

Figure 6:
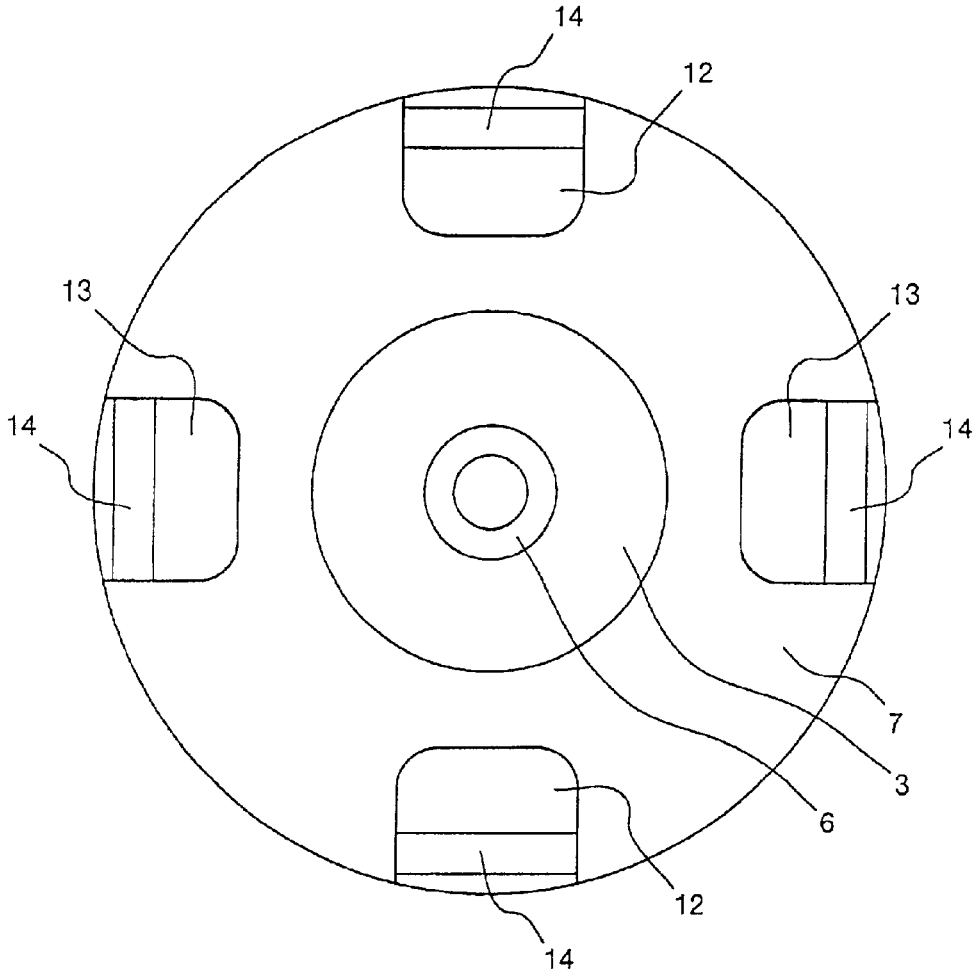
FIG. 6 is a cross-sectional view cut along A—A in FIG. 5.

FIG. 6 is a cross-sectional view cut along A—A in FIG. 5. As shown in this figure, at the backside of the cylinder unit end portion of the pilot nozzle 1, the fuel oil supply pipe 6 is disposed at the center of the heat-shielding air layer 3 provided along the axial core. The fuel oil supply pipe 6 is provided with spacers at various portions, and is positioned at the center of the heat-shielding air layer 3. A plurality of atomized-fluid supply paths 12 (two are shown in this figure) are disposed independently in the circumferential direction of the cylinder unit 7 that surrounds the outside of the heat-shielding air layer 3. When the pilot nozzle is a duel-fuel system, fuel gas supply paths 13 are also disposed independently in a circumferential direction of the cylinder unit 7 in the same manner as the atomized-fluid supply paths 12. FIG. 6 shows an example of a case where a pair of the atomized-fluid supply paths 12 are disposed opposite to each other and so are a pair of the fuel gas supply paths 13.

The atomized-fluid supply paths 12 and the fuel gas supply paths 13 are provided by forming grooves at the external edge of the cylinder unit 7. These grooves are covered with the external plates 14. Based on this structure, it is possible to take a larger thickness for the heat-shielding air layer 3 to a maximum extent in a radial direction, as compared with the conventional structure of securing a flow path by superimposing cylinders on one another. Further, as the atomized-fluid supply paths 12 and the gas supply paths 13 are disposed alternately and uniformly, there occurs no surplus deviation in the flow of the atomized fluid and the gas when they flow through the ring-shaped inter-cylinder flow path before the cylinder unit end portion. As a result, the jetting from the front end nozzle is stabilized.

Figure 7:
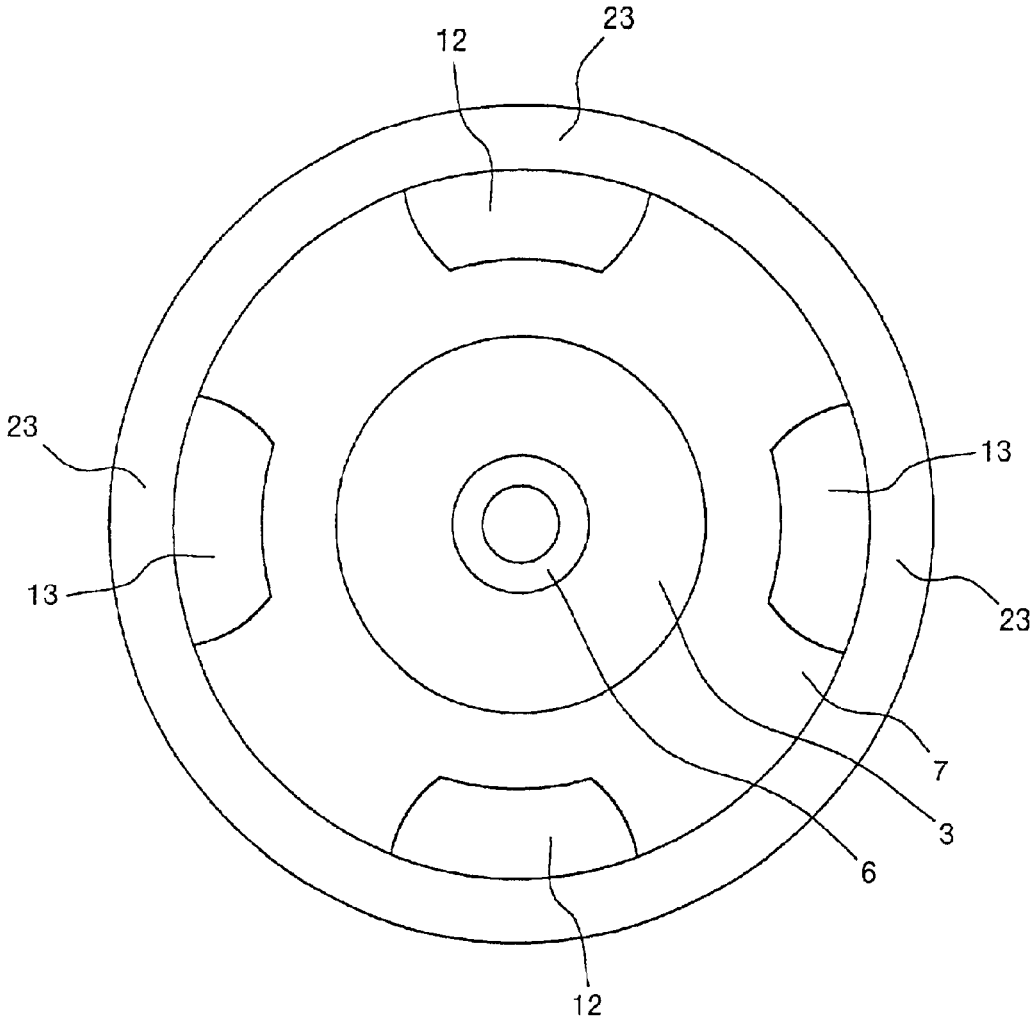
FIG. 7 is a cross-sectional view showing a modified example of the supply path shown in FIG. 6.

FIG. 7 is a cross-sectional view showing a modified example of the supply path cut along A—A. While the atomized-fluid supply paths 12 shown in FIG. 6 are formed by covering the grooves with the external plates 14, this modified example shows a structure having these grooves and the outer periphery of the cylinder unit 7 surrounded with a cylindrical member 23. Based on this structure, it is also possible to dispose the atomized-fluid supply paths 12 and the fuel gas supply paths 13 in the circumferential direction respectively. The cross-sectional shape of the grooves may be a quadrangle as shown in FIG. 6, or a shape having a large width in the groove bottom along a circular shape and having a shallow depth as shown in FIG. 7, or a round shape. Based on this, the structure becomes simple and the maintenance becomes easy.

Figure 8:
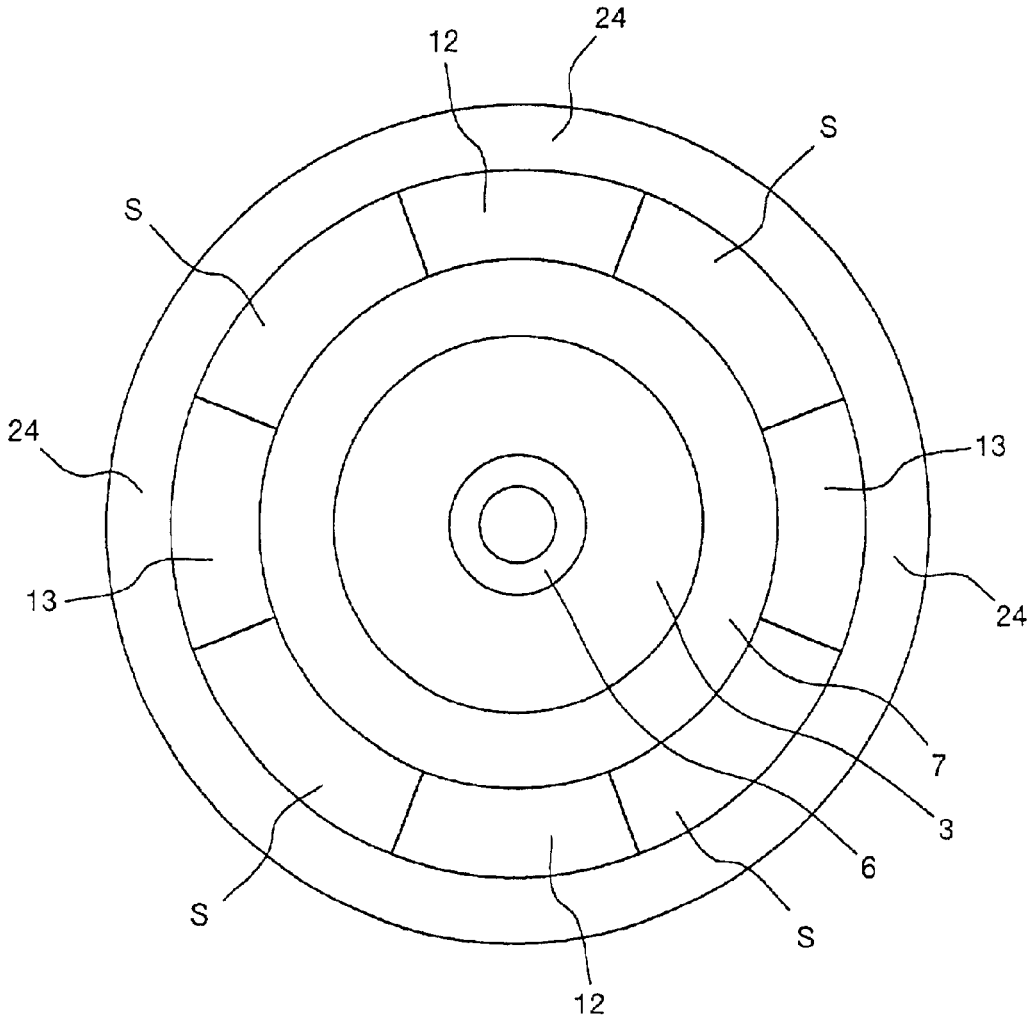
FIG. 8 is a cross-sectional view showing a modified example of the supply path shown in FIG. 6.

FIG. 8 is a cross-sectional view showing a modified example of the supply path cut along A—A. According to this structure, spacers S are fixed in a space formed between the cylinder unit 7 and a cylindrical member 24, thereby to form the atomized-fluid supply paths 12 and the fuel gas supply paths 13. Based on this structure, it is also possible to dispose the atomized-fluid supply paths 12 and the fuel gas supply paths 13 in the circumferential direction respectively, like in the cases shown in FIGS. 6 and 7. When the atomized-fluid supply paths 12 and others are processed in the form of grooves, it is possible to structure the supply paths, without carrying out the conventional laborious work of forming long holes or assembling by welding. Further, it is possible to lower the processing cost as compared with the conventional practice.

Figure 9A:
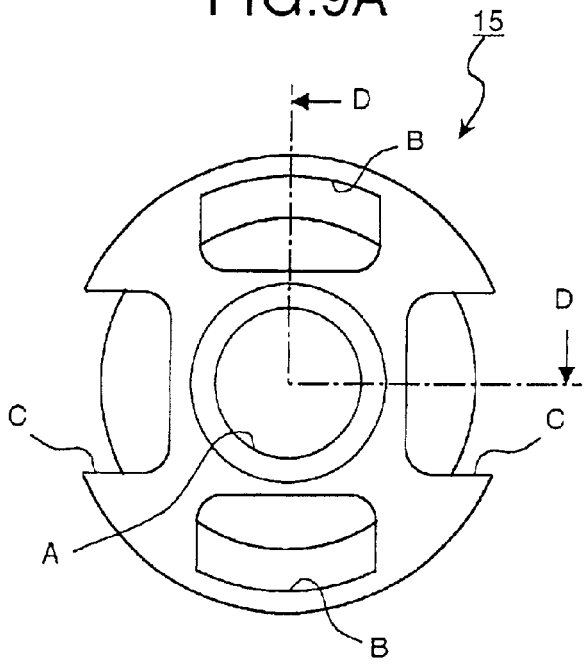
FIG. 9A is a front view.
Figure 9B:
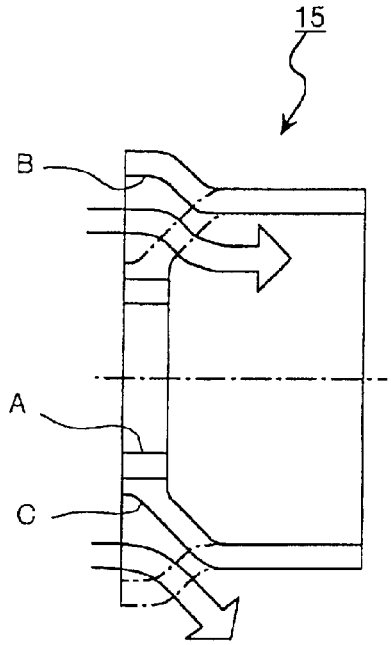
FIG. 9B is a cross-sectional view of the supply path converter.

FIG. 9A shows a front view and FIG. 9B shows a cross-sectional view of the supply path converter. The supply path converter 15 is a cylindrical structure having a hollow in its inside, and has a hole A at a center portion of the end surface at one end. A hole B communicated to the inside of the cylindrical structure and a flow path C communicated to the outside of the cylindrical structure are formed respectively at the outside of the end surface in the radial direction of the hole A. The fuel oil supply pipe 6 having substantially the same diameter as the hole A is passed through the hole A, and the atomized-fluid supply paths 12 and the fuel gas supply paths 13 disposed in the circumferential direction of the same end surface are connected to the hole B and the flow path C, respectively. As shown in FIG. 9A, the flow path C is a groove formed inward from the external edge portion, this may be formed as a hole.

As the fuel oil supply pipe 6 having substantially the same diameter as the hole A is passed through the hole A, a ring-shaped space is formed at the outside of the fuel oil supply pipe 6 inside the cylindrical structure. When the atomized fluid that flows through the atomized-fluid supply paths 12 disposed in the circumferential direction enters the hole B, this atomized fluid flows inside the cylindrical structure, and flows through the ring-shaped space. Further, when the gas enters the flow path C, this flows to the outside of the structure. As the structure is disposed at the inside of the cylindrical space, the fluid flows circularly at the outside of the side portion of the cylindrical structure and the inside of the cylindrical space.

As explained above, this supply path converter 15 can distribute the plurality of supply paths 12 and 13 disposed in the circumferential direction to the inside and the outside of the supply path converter 15. Therefore, when the fuel gas supply paths 13 are disposed in the circumferential direction in order to take a large thickness for a heat-shielding air layer 3, it is possible to smoothly convert the paths into the ring-shaped inter-cylinder flow path at the front end of the pilot nozzle 1. With this arrangement, it is possible to jet and diffuse the fuel in the same manner as the conventional one at the front end of the nozzle, while improving the heat-shielding effect at most portions of the pilot nozzle. From the viewpoint of designing, it is preferable to set the external size of the end surface in which the hole A is provided larger than the external size of the other end, thereby smoothly changing the external size between these portions. This makes it possible to smoothly distribute the fluid that enters from the supply paths.

Figure 10:
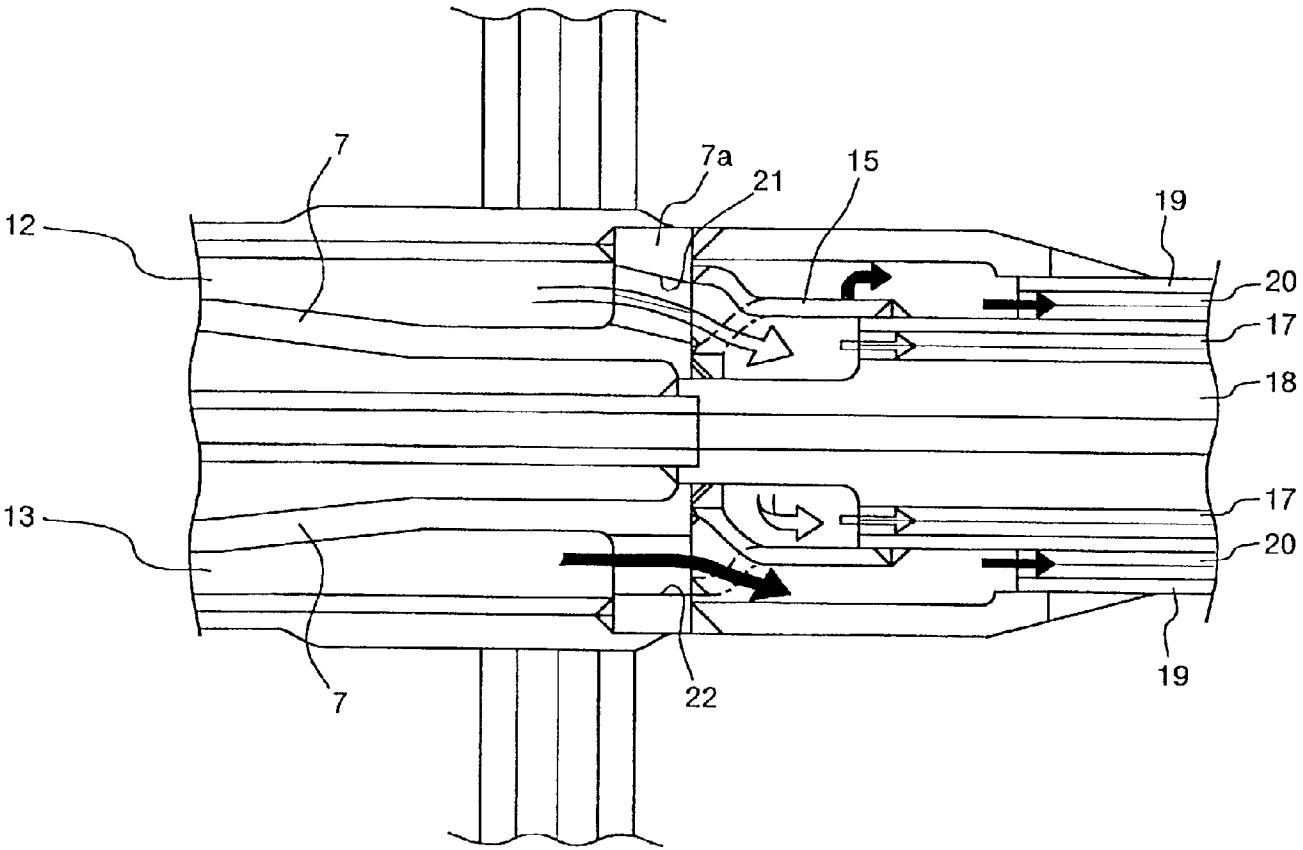
FIG. 10 is a cross-sectional view of the pilot nozzle showing a flow of an atomized fluid and a fuel gas.
Figure 11:
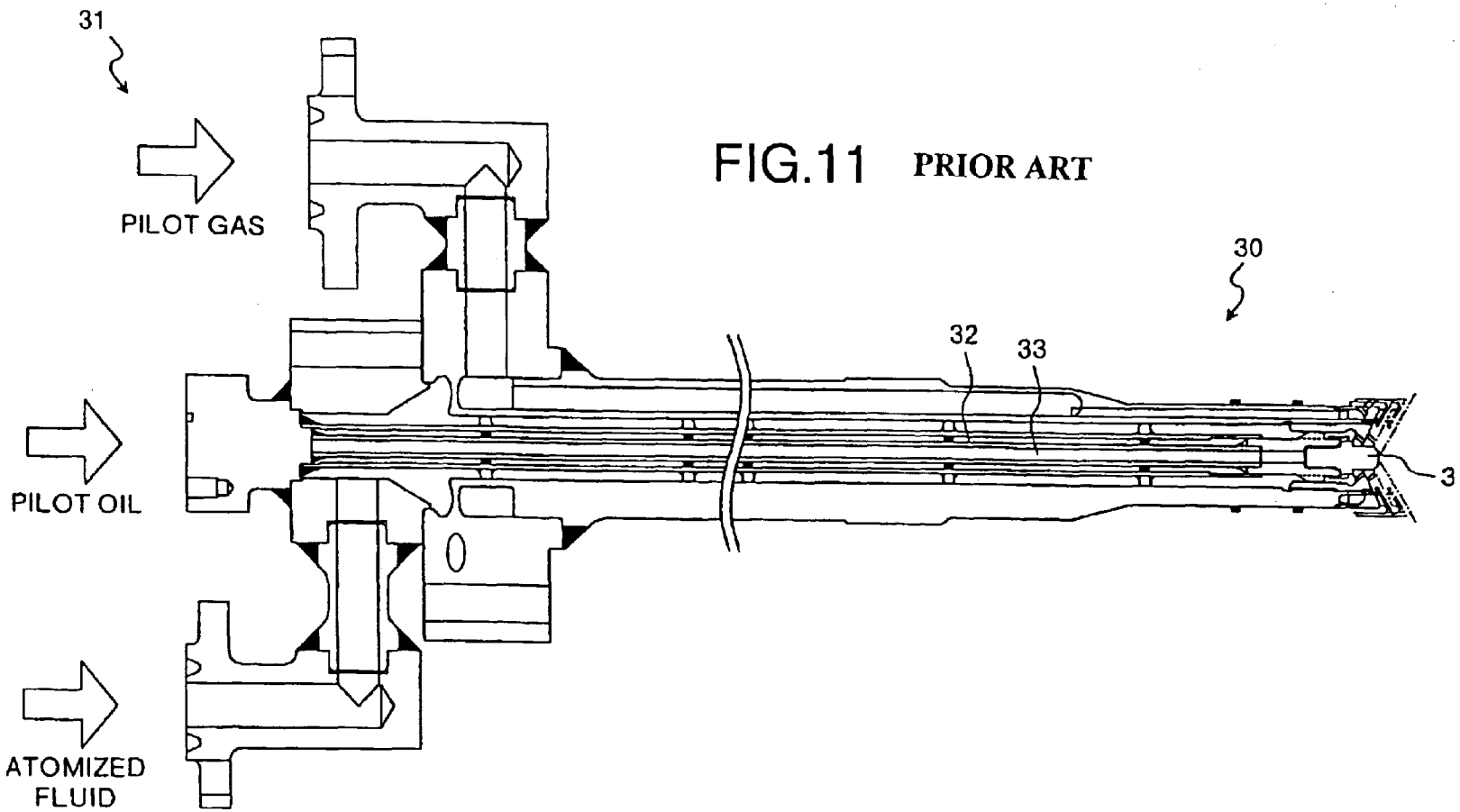
FIG.11 PRIOR ART
FIG. 11 is a construction diagram showing the pilot nozzle of the conventional gas turbine combustor.
Figure 12:
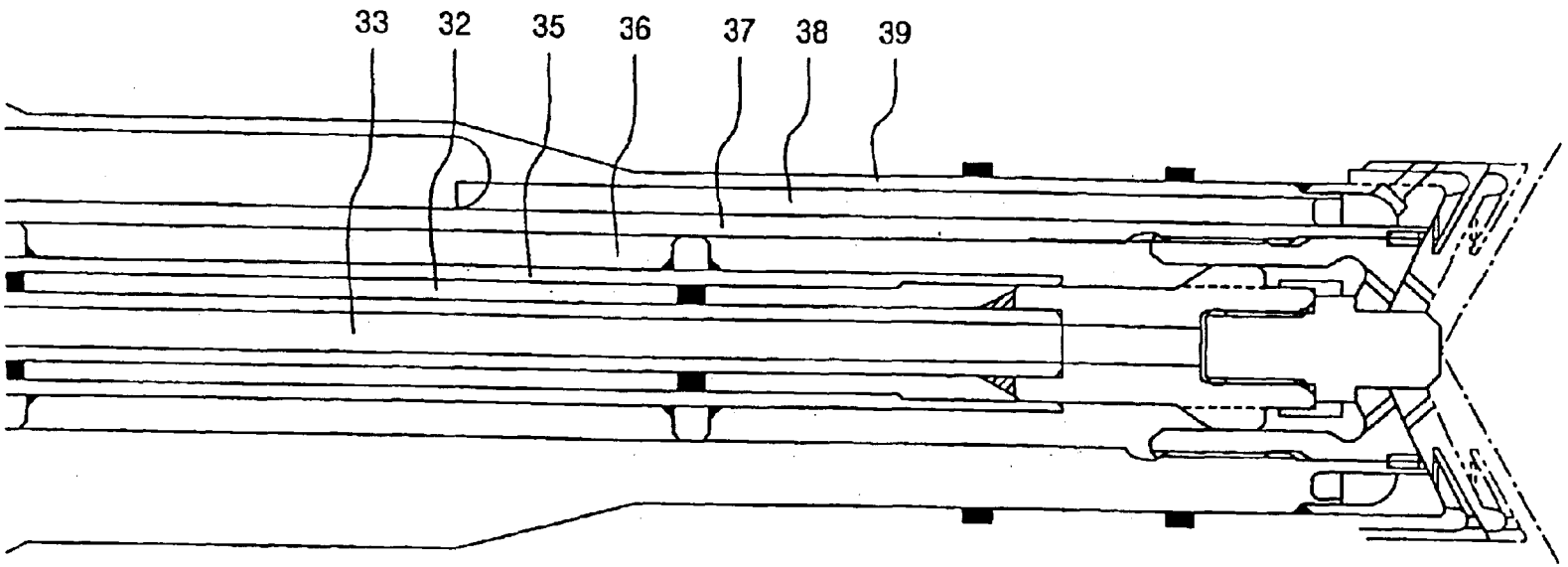
FIG.12 PRIOR ART
FIG. 12 is a cross-sectional view showing a front end portion of the nozzle shown in FIG. 11.

FIG. 10 is a cross-sectional view of the pilot nozzle showing a flow of the atomized fluid and the fuel gas before and after the supply path converter. For convenience in the explanation, this figure shows a cross section of the pilot nozzle cut along an L-shaped surface bent at a right angle with respect to the axial core. As shown in FIG. 10, the atomized fluid flows from the atomized-fluid supply paths 12 disposed independently in the circumferential direction of the cylinder unit 7, to the supply path converter 15 at the front via a hole 21 at the cylinder unit end portion 7*a*. Then, the atomized fluid flows (open arrows) into the inside of the supply path converter 15, and flows smoothly through the ring-shaped inter-cylinder flow path 17 formed in the trunk portion 18.

On the other hand, the fuel gas flows from the fuel gas supply paths 13 disposed in the circumferential direction of the cylinder unit 7, to the supply path converter 15 at the front via a hole 22 at the cylinder unit end portion 7*a*. Then, the fuel gas flows (black arrows) into the outside of the supply path converter 15, and flows smoothly through the inter-cylinder flow path 20 as the ring-shaped space formed between the outside of the trunk portion 18 and the forward external cylinder unit 19.

As explained above, as the pilot nozzle 1 for a gas turbine combustor has a structure capable of taking a thick heat-shielding air layer 3, it is possible to restrict a rise in the temperature of the fuel oil within the fuel oil supply pipe. As a result, it is possible to prevent the occurrence of caulking attributable to the rise in the temperature of the fuel oil. Further, this structure can also employ a pilot nozzle of what is called a duel-fuel system that carries out the diffusion of the fuel based on the atomized fluid, and the switching between the fuel gas and the fuel oil or the parallel use. The heat-shielding air layer 3 in this embodiment can take a thickness approximately three times that of the heat-shielding air layer according to the conventional technique.

As explained above, according to one aspect of this invention, it is possible to structure the pilot nozzle of a duel-fuel system by providing the atomized-fluid supply path in the circumferential direction of the cylinder unit. Based on this structure, it is not necessary to take into account a wall thickness of the multi-layer cylinders inside the pilot nozzle. It is possible to take a large thickness for a heat-shielding air layer by that portion. As a result, it is possible to prevent the occurrence of caulking attributable to the rise in the temperature of the fuel oil within the fuel oil supply pipe.

According to another aspect of this invention, it is possible to take a large thickness for a heat-shielding air layer and thereby to prevent the occurrence of caulking attributable to the rise in the temperature of the fuel oil within the fuel oil supply pipe. Further, this structure can also employ the pilot nozzle of what is called the duel-fuel system that carries out the diffusion of the fuel based on the atomized fluid, and the switching between the fuel gas and the fuel oil or the parallel use.

Further, it is possible to take a large thickness for a heat-shielding air layer and thereby to prevent the occurrence of caulking of the fuel oil within the fuel oil supply pipe. Further, it is possible to contribute to a stabilized combustion of the fuel jetted from the main nozzle, by stabilizing the flame from the pilot nozzle without deviation.

Further, a difference between the expansion of the cylinder unit and the expansion of the fuel oil supply pipe due to a difference between their temperatures during the operation of the gas turbine can be absorbed by the structure that does not restrict the expansion of the two to the axial direction. Accordingly, thermal stress attributable to the compression does not occur easily at the front end nozzle of the pilot nozzle or other portions. As a result, it becomes possible to avoid exerting a bad influence on the jet nozzle and the status of the diffusion of the jetted fuel.

Further, as the thickness of the heat-shielding air layer is taken large, it is possible to smoothly convert the fuel gas supply paths and the atomized-fluid supply paths that are disposed alternately and uniformly in the circumferential direction, into the ring-shaped inter-cylinder flow path. With this arrangement, the flow of the fuel gas and the atomized fluid is not deviated easily, and it becomes possible to jet and diffuse the fuel uniformly. Thus, it is possible to structure the pilot nozzle capable of restricting bad influence from the external high temperature as a whole.

According to still another aspect of this invention, this supply path converter can distribute the plurality of supply paths disposed in the circumferential direction to the inside and the outside of the supply path converter. Therefore, when the fuel supply paths are disposed in the circumferential direction in order to take a large thickness for a heat-shielding air layer, it is possible to easily convert the paths into the ring-shaped supply paths at the front end of the pilot nozzle. With this arrangement, it is possible to jet and diffuse the fuel in the same manner as the conventional one at the front end of the nozzle, while improving the heat-shielding effect at most portions of the pilot nozzle.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A pilot nozzle for a gas turbine combustor comprising:

a fuel oil supply pipe passed through a cylinder unit provided in an axial direction of the pilot nozzle; the fuel oil supply pipe having a rear end portion for supplying fuel therefrom;

a plumber block slidably holding the fuel oil supply pipe such that the plumber block allows the rear end portion of the fuel oil supply pipe to be slidably displaced in the axial direction due to thermal expansion or compression;

a heat-shielding air layer formed between the fuel oil supply pipe and the cylinder unit; and a plurality of atomized-fluid supply paths provided in a circumferential direction of the cylinder unit.

2. A pilot nozzle for a gas turbine combustor comprising:

a fuel oil supply pipe passed through a cylinder unit provided in an axial direction of the pilot nozzle;

a plumber block for holding the fuel oil supply pipe, the plumber block allowing the fuel oil supply pine to expand and shrink in the axial direction as a result of thermal expansion or compression;

a heat-shielding air layer formed between the fuel oil supply pine and the cylinder unit;

a plurality of atomized-fluid supply paths provided in a circumferential direction of the cylinder unit:

a plurality of fuel gas supply paths provided in a circumferential direction of the cylinder unit;

a front end portion connected to an end portion of the cylinder unit; and a distribution section disposed between the cylinder unit and the front end portion, wherein the fuel gas supply paths and the atomized-fluid supply paths are disposed alternately in the circumferential direction respectively within the cylinder unit, the front end portion is provided with an atomized-fluid flow path and a fuel gas flow path which is disposed outside the atomized-fluid flow path, and the distributing section connects the fuel gas supply paths with the fuel gas flow path and the atomized-fluid supply paths with the atomized-fluid flow path respectively, the distributing section is disposed inside the front end portion, and has a supply path converter which has a hole through which the fuel oil supply pipe is connected to a fuel supply path, a first converting flow path through which the atomized-fluid supply paths are converted to the atomized-fluid flow path having a ring-shaped cross-section, and a second converting flow path through which the fuel gas supply paths are converted to the fuel gas flow path having a ring-shaped cross-section.

3. A pilot nozzle for a gas turbine combustor comprising:

a fuel oil supply pipe passed through a cylinder unit provided in an axial direction of the pilot nozzle;

a heat-shielding air layer formed between the fuel oil supply pipe and the cylinder unit; and a plurality of atomized-fluid supply paths and fuel gas supply paths disposed uniformly in a circumferential direction of the cylinder unit, wherein the fuel oil supply pipe has a rear end portion for supplying the fuel therefrom and the rear end portion is slidably held such that the rear end portion is slidably displaced in the axial direction due to thermal expansion or compression.

4. A pilot nozzle for a gas turbine comprising:

a fuel oil supply pipe passed through a cylinder unit provided in an axial direction of the pilot nozzle;

a heat-shielding air layer formed between the fuel oil supply pipe and the cylinder unit;

a plurality of atomized-fluid supply paths and fuel gas supply paths provided in a circumferential direction of the cylinder unit;

a front end portion connected to an end portion of the cylinder unit; and a distributing section disposed between the cylinder unit and the front end portion, wherein the fuel gas supply paths and the atomized-fluid supply paths are disposed alternately and uniformly in the circumferential direction respectively within the cylinder unit, the front end portion is provided with an atomized-fluid flow path and a fuel gas flow path which is disposed outside the atomized-fluid flow path, and the distributing section connects the fuel gas supply paths with the fuel gas flow path and the atomized-fluid supply paths with the atomized-fluid flow path respectively.

5. The pilot nozzle according to claim 4, wherein the distributing section is disposed inside the front end portion, and has a supply path converter which has a hole through which the fuel oil supply pipe is connected to a fuel supply path, a first converting flow path through which the atomized-fluid supply paths are converted to the atomized-fluid flow path having a ring-shaped cross-section, and a second converting flow path through which the fuel gas supply paths are converted to the fuel gas flow path having a ring-shaped cross-section.

6. A pilot nozzle for a gas turbine combustor comprising:

a fuel oil supply pipe passed through a cylinder unit provided in an axial direction of the pilot nozzle;

a beat-shielding air layer formed between the fuel oil supply pipe and the cylinder unit;

a plurality of atomized-fluid supply paths disposed uniformly in a circumferential direction of the cylinder unit;

a front end portion connected to an end portion of the cylinder unit; and a distributing section disposed between the cylinder unit and the front end portion, wherein the fuel oil supply pipe has a rear end portion for supplying the fuel therefrom, and the rear end portion is slidably held such that the rear end portion is slidably displaced in axial direction due to thermal expansion or compression, wherein the fuel gas supply paths and the atomized-fluid supply paths are disposed alternately and uniformly in the circumferential direction respectively within the cylinder unit, the front end portion is provided with an atomized-fluid flow path and a fuel gas flow path which is disposed outside the atomized-fluid flow path, and the distributing section connects the fuel gas supply paths with the fuel gas flow path and the atomized-fluid supply paths with the atomized-fluid flow path respectively, wherein the distributing section is disposed inside the front end portion, and has a supply path converter which has a hole through which the fuel oil supply pipe is connected to a fuel supply path, a first converting flow path through which the atomized-fluid supply paths are converted to the atomized-fluid flow path having a ring-shaped cross-section, and a second converting flow path through which the fuel gas supply paths are converted to the fuel gas flow path having a ring-shaped cross-section.

* * * * *